US007473011B2

(12) United States Patent
Wilcox et al.

(10) Patent No.: US 7,473,011 B2
(45) Date of Patent: Jan. 6, 2009

(54) METHOD AND APPARATUS FOR MOUNTING AN LED MODULE TO A HEAT SINK ASSEMBLY

(75) Inventors: Kurt S. Wilcox, Libertyville, IL (US); Wayne Guillien, Franksville, WI (US); Clint Knollenberg, Racine, WI (US); Brian L. Kinnune, Racine, WI (US); Steven R. Walczak, Hales Corners, WI (US)

(73) Assignee: Ruud Lighting, Inc., Racine, WI (US)

( * ) Notice: Subject to any disclaimer, the term of this patent is extended or adjusted under 35 U.S.C. 154(b) by 67 days.

(21) Appl. No.: 11/744,630

(22) Filed: May 4, 2007

(65) Prior Publication Data

US 2008/0273341 A1 Nov. 6, 2008

(51) Int. Cl.
*F21V 29/00* (2006.01)

(52) U.S. Cl. ..... 362/294; 362/396; 362/800; 257/712

(58) Field of Classification Search ..... 362/294, 362/373, 389, 396, 800; 257/712, 718, 720
See application file for complete search history.

(56) References Cited

U.S. PATENT DOCUMENTS 5,276,585 A 1/1994 Smithers
5,307,239 A 4/1994 McCarty et al.
5,329,426 A 7/1994 Villani
5,586,005 A 12/1996 Cipolla et al.
6,832,675 B2 12/2004 Kao et al.
7,255,463 B2 * 8/2007 Wang et al. ..... 362/294

* cited by examiner

*Primary Examiner*—Stephen F Husar
(74) *Attorney, Agent, or Firm*—Jansson Shupe & Munger Ltd.

(57) ABSTRACT

A heat sink assembly for mounting an LED module to a surrounding main heat sink member is disclosed. The heat sink assembly has a first plate with inner and outer faces and a peripheral edge. The assembly further includes a second plate that is movable with respect to the first plate and has inner and outer faces and an inwardly-tapered peripheral camming surface. Also included in the assembly is an expandable ring sandwiched between the first and second plates. The ring has an inward peripheral edge that engages the camming surface and an outward heat-transfer surface. The ring is expandable beyond the peripheries of the first and second plates. The heat sink assembly also has a sandwiching-device that adjustably interconnects the first and second plates such that sandwiching of the ring facilitates heat-transfer engagement of the heat-transfer surface with the main heat sink member.

28 Claims, 7 Drawing Sheets

SECTION A-A
SCALE 1 : 4

METHOD AND APPARATUS FOR MOUNTING AN LED MODULE TO A HEAT SINK ASSEMBLY

FIELD

The invention relates generally to the field of lighting systems and, more particularly, to apparatus for mounting LED light sources in a lighting apparatus.

BACKGROUND

Light emitting diodes (LEDs) offer exciting benefits in the field of lighting apparatus. There is a strong trend in the industry to replace conventional incandescent light sources with LED units. Among the advantages offered by LED modules is increased flexibility of use. LED modules generally comprise an array of LED units each unit including a reflector (and optionally a refractor) and an LED. The assembly is durable and long-lasting. This arrangement further allows much smaller packages of such light sources which translate into much lower material usage within fixtures containing such sources. Another significant advantage of LEDs is that they yield reliable light with low-power consumption. Further, a solid package of LEDs may be positioned to focus light as might be required.

One of the main hurdles to using LEDs in certain applications is the management of the heat generated by the LED modules. Generally, LEDs themselves create little heat because of their high efficiency as measured by light output per unit power input. There are, however, LEDs that, due to their higher operating currents, may generate considerable more heat than traditional LED modules. Other power-related components within the lighting fixture may also create significant heat. LED performance, and the performance of other power-related components, is directly related to the amount of ambient heat within the housing of a lighting fixture. High levels of heat in a lighting fixture compromise the functionality and life of certain components that are highly susceptible to heat, including LED modules, ballasts, capacitors and other power-related components. The concern of heat is even more pronounced where LEDs are mounted in a confined space or more than one LED package is used. In such circumstances, it is especially crucial to manage the heat created by the LED module for optimal performance and to protect the overall life of the fixture.

It is known in the art to use a heat-dissipating structure, such as an aluminum plate, for mounting an LED module. This approach has a significant disadvantage in that the plate is generally welded to the housing. Welding of a heat-dissipating structure to the interior of a housing typically causes undesirable distortion of the housing. Alternatively, the heat-dissipating structure may be forced into the housing. This is undesirable because assembling a heat-dissipating structure in this manner typically requires the application of over two tons of force; consequently, the interior of the housing may be significantly damaged during assembly. Further, the application of such tremendous force makes it nearly impossible in the future to remove the heat-dissipating structure for access to the housing.

The relative permanency of traditional heat-dissipating structures within a lighting apparatus housing makes it much more difficult, costly and time-consuming to perform routine maintenance. These problems are only exacerbated in certain lighting fixtures that utilize more than one LED module. For example, in a bollard lighting fixture, it may be desirable in some circumstances to provide two LED modules, one being mounted in the upper portion of a tubular housing and the other in the lower portion of the housing. Where two heat-dissipating plates are welded to the housing, this would significantly impair one's ability to enter the housing for routine maintenance. There is, therefore, a need for lighting apparatus including an LED module where the LED is mounted on a heat-dissipating structure that is easily removable, thereby allowing access to the interior regions of the lighting fixture.

OBJECTS

It is an object, in the field of lighting systems, to provide LED lighting apparatus which has improved dissipation of heat and which overcomes some of the problems and shortcomings of the prior art.

Another object is to provide an improved LED module mounting unit that is easily removable from the housing of a lighting fixture.

Another object is to provide a bollard luminaire having improved efficiency and product life.

Yet another object is to provide a bollard luminaire having improved lower temperature of operation.

Another object is to provide a bollard luminaire having a simplified construction and assembly.

Still another object is to provide a bollard luminaire that is easier and less expensive to manufacture, assemble and maintain.

These and other objects of the invention will be apparent from the following descriptions and the drawings.

SUMMARY

The invention is an LED lighting apparatus having a heat sink assembly and, more broadly considered, a heat sink assembly for mounting an LED module to a surrounding heat sink member. Further disclosed is a method for mounting the inventive removable heat-sink assembly.

The LED lighting apparatus includes a tubular housing and a heat sink assembly for mounting an LED module to the inside of the housing. The heat sink assembly includes a first plate, a second plate movable with respect to the first plate, an expandable ring sandwiched between the first and second plates. The sandwiching device adjustably interconnects the first and second plates. The first plate includes inner and outer faces and a peripheral edge. The second plate includes inner and outer faces and an inwardly-tapered peripheral camming surface. The expandable ring includes an inward peripheral edge engaging the camming surface and an outward heat-transfer surface and is expandable to beyond the peripheries of the first and second plates.

Sandwiching of the ring occurs upon tightening of the sandwiching device which draws the second plate toward the first plate thereby causing expansion of the ring into heat-transfer contact with the interior of the housing. The sandwiching interaction facilitates transfer of heat generated by the LED module from the heat sink assembly to the interior of the housing. The ring is expandable to beyond the peripheries of the first and second plates for optimal heat transfer.

In certain embodiments the tubular housing is made of a heat-conductive material such that it forms a main heat sink member.

In most preferred embodiments, the second plate defines an aperture through which the sandwiching device extends and the inner surface of the first plate includes a receptor port configured for drawing engagement with the sandwiching device. In such embodiments, the receptor port can be threaded and the sandwiching device can be a screw, the rotation of which draws the second plate toward the first plate.

In other highly preferred embodiments, the expandable ring includes a gap and the gap facilitates radial expansion of the ring.

In some embodiments, the inward peripheral edge of the expandable ring and the inwardly-tapered peripheral camming surface are substantially parallel.

In yet other embodiments, the first and second plates have substantially equivalent footprints. In such embodiments, the first and second plates and the ring are substantially circular. The first and second plates and the ring may be concentrically mounted with respect to each other.

In most preferred embodiments, the heat sink assembly is made of heat-conductive material.

The invention further includes a method for mounting a removable heat-transfer facilitating assembly in a lighting apparatus having a tubular housing. The method includes the steps of providing a heat sink assembly having first and second plates, an expandable ring and a sandwiching device, each as described above. The second plate is drawn toward the first plate, thereby sandwiching the expandable ring such that the heat-transfer surface is biased against the interior of the tubular housing. The method facilitates easy access to the interior of the housing for routine maintenance and repair.

BRIEF DESCRIPTION OF THE DRAWINGS

FIG. 2 is a top perspective view of the heat sink assembly and FIG. 2A is a cross-section of the heat sink assembly shown in FIG. 2 taken along section A-A.

DETAILED DESCRIPTION OF PREFERRED EMBODIMENTS

One embodiment of the heat sink assembly for mounting an LED module to a surrounding main heat sink member is shown in the figures as assembly 10. Heat sink assembly 10 is made of a heat-conductive material. Any suitable metal may be used for this purpose. Aluminum is a preferred material because of its cost-effectiveness. Those skilled in the art will recognize that any thermally-conductive metal could be used. Though metal is a preferred material, other materials may be used, such as thermally-conductive plastics. However, to facilitate optimal heat-transfer between the heat sink assembly and the tubular housing, metal is most preferred.

Figure 1:
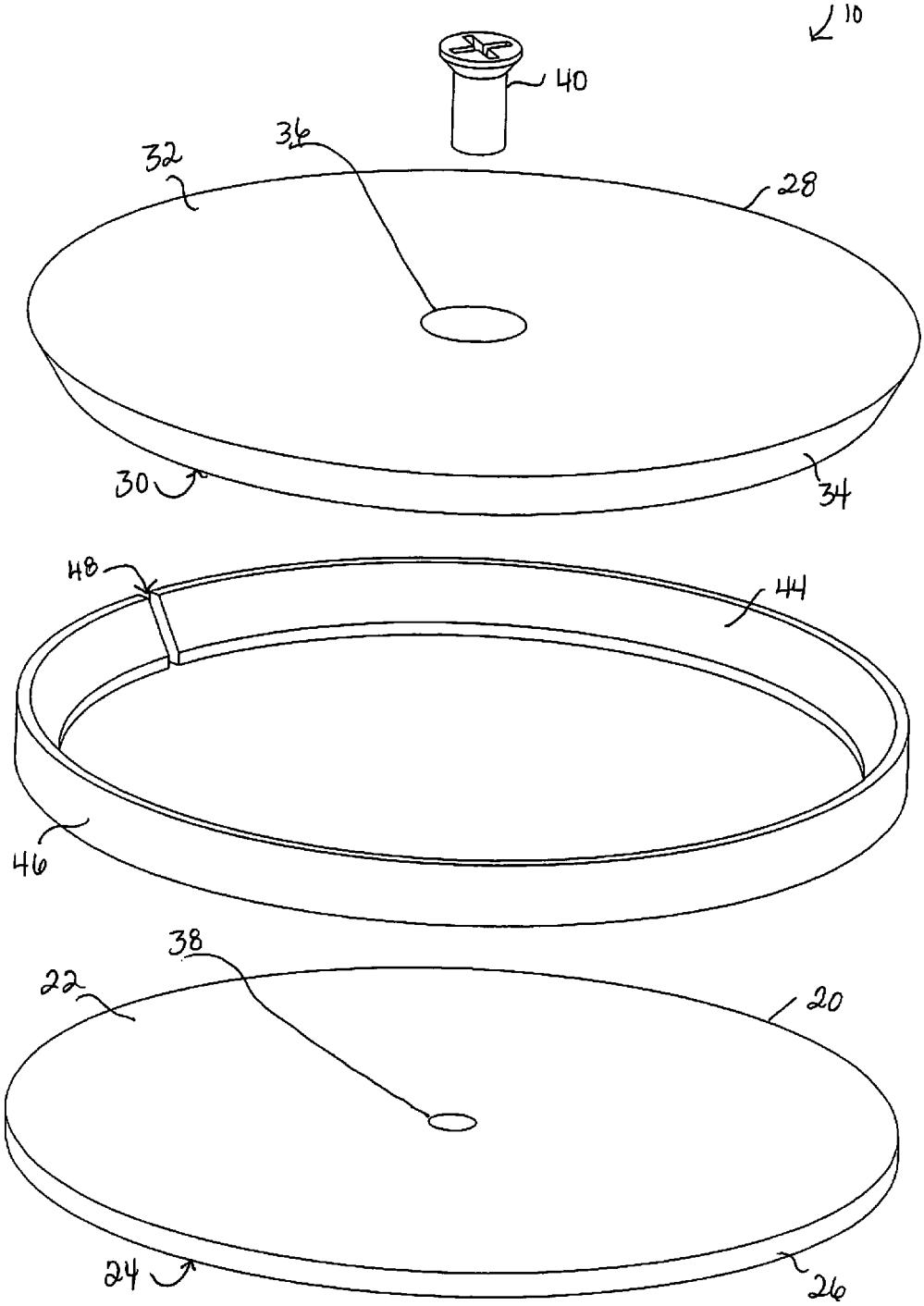
FIG. 1 is an exploded perspective view of one embodiment of the heat sink assembly.

Referring to FIG. 1, heat sink assembly 10 includes a first plate 20 having inner and outer faces, 22 and 24 respectively, and a peripheral edge 26. Also shown is the second plate 28. Second plate 28 includes inner and outer faces, 30 and 32 respectively, and an inwardly-tapered peripheral camming surface 34. Second plate 28 further includes an aperture 36 through the center of plate 28. Correspondingly, first plate 20 includes a receptor port 38 formed in the center of plate 20. Aperture 36 is designed to allow a sandwiching device 40 to extend therethrough and receptor port 38 receives sandwiching device 40. Sandwiching device 40 may be a screw, bolt or any other suitable type of securement device. As shown, receptor port 38 is an opening extending through first plate 20. However, receptor port 38 may be structured in such a way that port 38 does not extend throughout first plate 20, but extends only partially through first plate 20 while still adapted to fully engage and receive sandwiching device 40.

Figure 2:
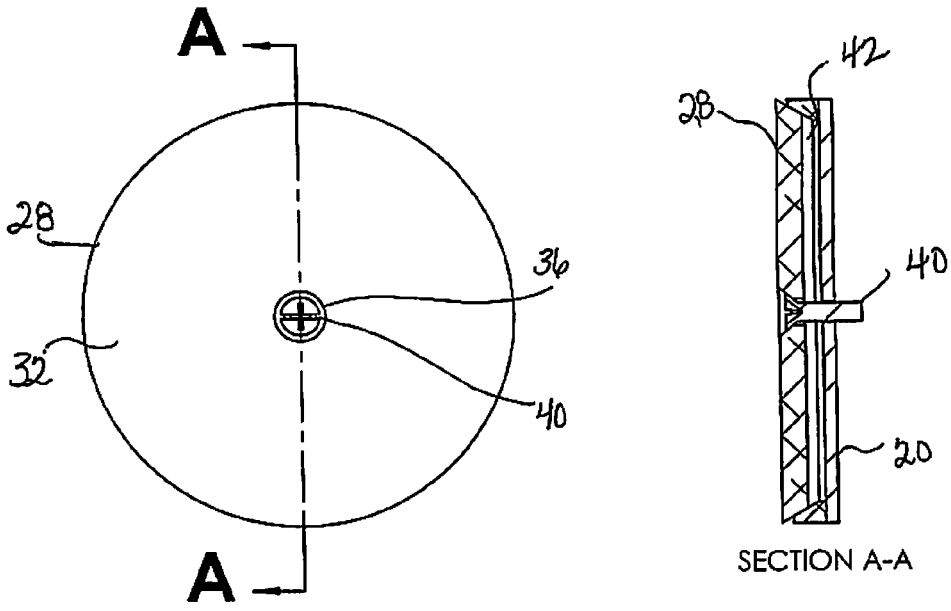
Figure 3A:
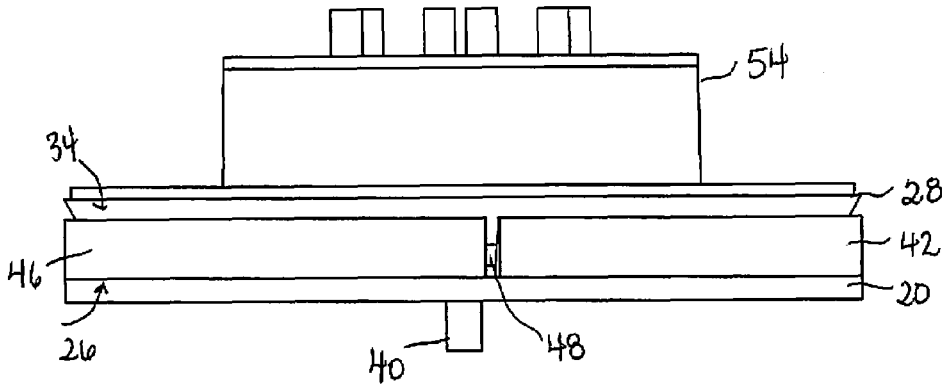
FIG. 3A is a side view of the heat sink assembly with an LED module mounted thereon showing the heat sink assembly when the sandwiching device is not tightened and FIG. 3B is side view of the heat sink assembly showing the assembly when the sandwiching device has been tightened.
Figure 3B:
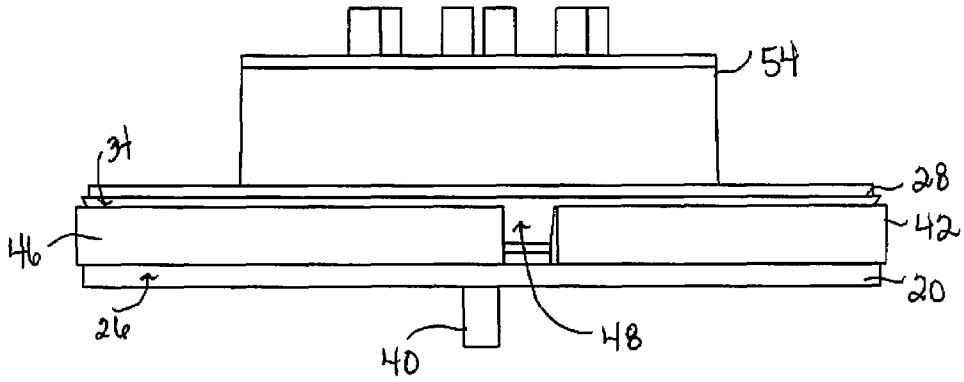

Further, as shown in FIG. 1, heat sink assembly 10 includes an expandable ring 42 which includes an inward peripheral edge 44 and an outward heat-transfer surface 46. Expandable ring 42 further includes a gap 48, as best illustrated in FIGS. 3A and 3B. When sandwiching device 40 is inserted through aperture 36 and received in receptor port 38, but before sandwiching device 40 is tightened, it can be seen that the periphery of expandable ring 42 is substantially equivalent to the peripheries of first and second plates, 20 and 28 respectively, as shown in FIG. 2A. FIG. 2 further shows that heat sink assembly 10 and an LED module 54 may be combined for mounting to a surrounding heat sink member.

As shown in FIG. 3B, when sandwiching device 40 is inserted through aperture 36 and received in receptor port 38, sandwiching device 40 may then be tightened, for example by rotation of a screw. As sandwiching device 40 is tightened, second plate 28 is drawn inwardly toward first plate 20. This sandwiching interaction is facilitated by inward peripheral edge 44 of expandable ring 42. As sandwiching device 40 is tightened, inward peripheral edge 44 engages camming surface 34. As illustrated in FIG. 2, inward peripheral edge 44 of ring 42 and camming surface 34 are substantially parallel. The sandwiching interaction is further facilitated by gap 48 in expandable ring 42. As second plate 28 is drawn toward first plate 20, this action sandwiches expandable ring 42. As more force is applied against expandable ring 42 due to tightening of sandwiching device 40, gap 48 expands, as shown in FIG. 3B. When gap 48 is in its expanded position, ring 42 expands to beyond the peripheries of first and second plates, 20 and 28 respectively.

Figure 4A:
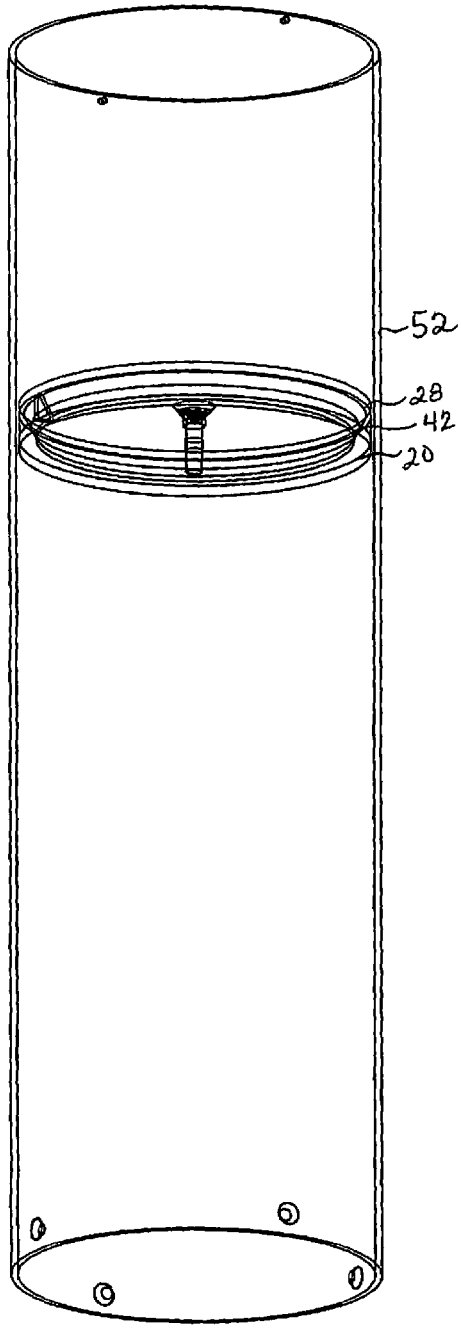
FIG. 4A is perspective view of LED lighting apparatus showing an exploded view of the heat sink assembly within the housing.
Figure 4B:
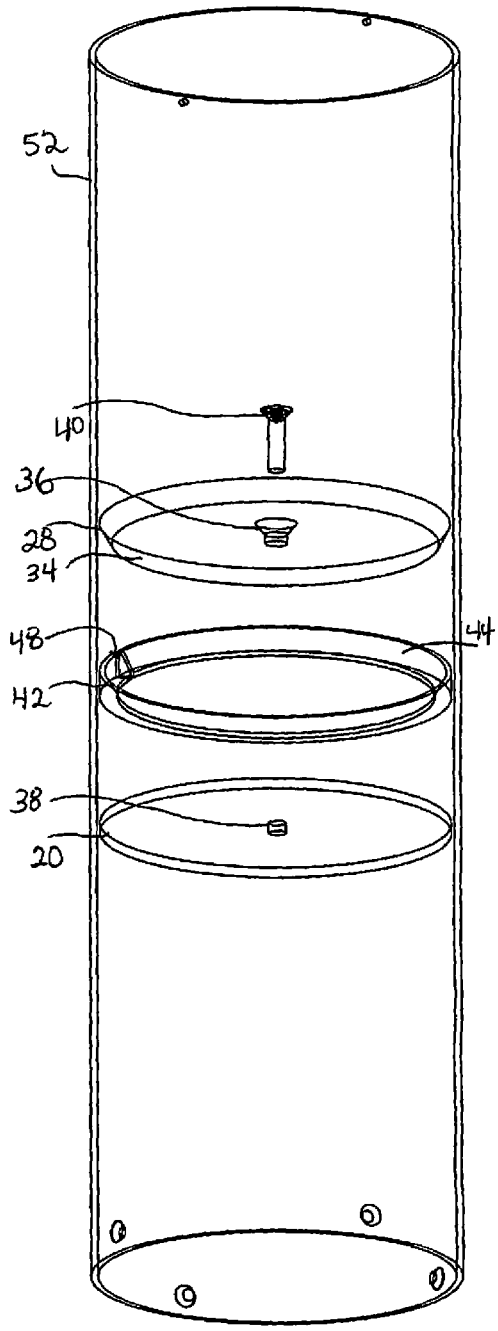
FIG. 4B shows the same LED lighting apparatus wherein the heat sink assembly is tightened by the sandwiching device.

Referring now to FIGS. 4A and 4B, heat sink assembly 10 is shown mounted to a main heat sink member. The main heat sink member is a tubular housing 52 of an LED lighting apparatus 50. Tubular housing 52 may be a vertical housing, as shown in the FIGS. 6 and 7. However, tubular housing 52 may also be mounted horizontally or in any other suitable orientation depending upon the needs of the lighting environment. When heat sink assembly 10 is mounted in tubular housing 52, assembly 10 has a friction-fit with the sides of tubular housing 52 to secure assembly 10 in place as desired. Other structures designed to work as a "stop" to prevent heat sink assembly 10 from moving could also be used. For example, brackets (not shown) may be used to support heat sink assembly in tubular housing.

FIG. 4A shows heat sink assembly 10 before sandwiching device 40 is inserted through aperture 36 of second plate 28 and used to draw second plate 28 toward first plate 20. FIG. 4A further illustrates that outward heat-transfer surface 46 of expandable ring 42 is in heat-conductive contact with the interior of tubular housing 52. Further, as shown, peripheral edge 44 of first plate 20 is also in substantial thermal contact with interior of tubular housing 52. At least portions of inwardly-tapered peripheral camming surface 34 are in further heat-conductive contact with the interior of tubular housing 52.

Figure 6:
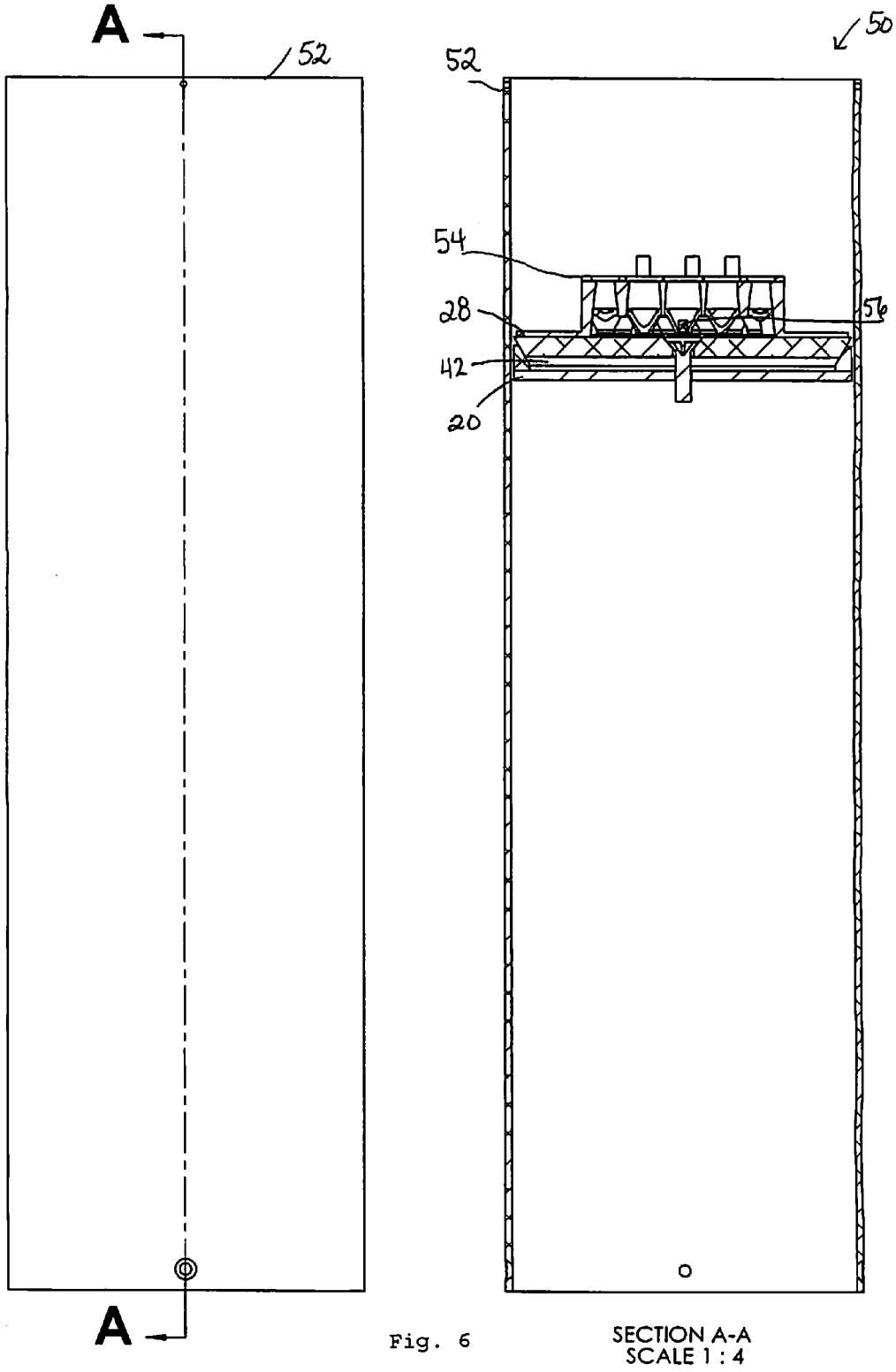
FIG. 6 is a cross-sectional view of the LED lighting apparatus shown in FIGS. 4A and 4B, taken along section line A-A.
Figure 7:
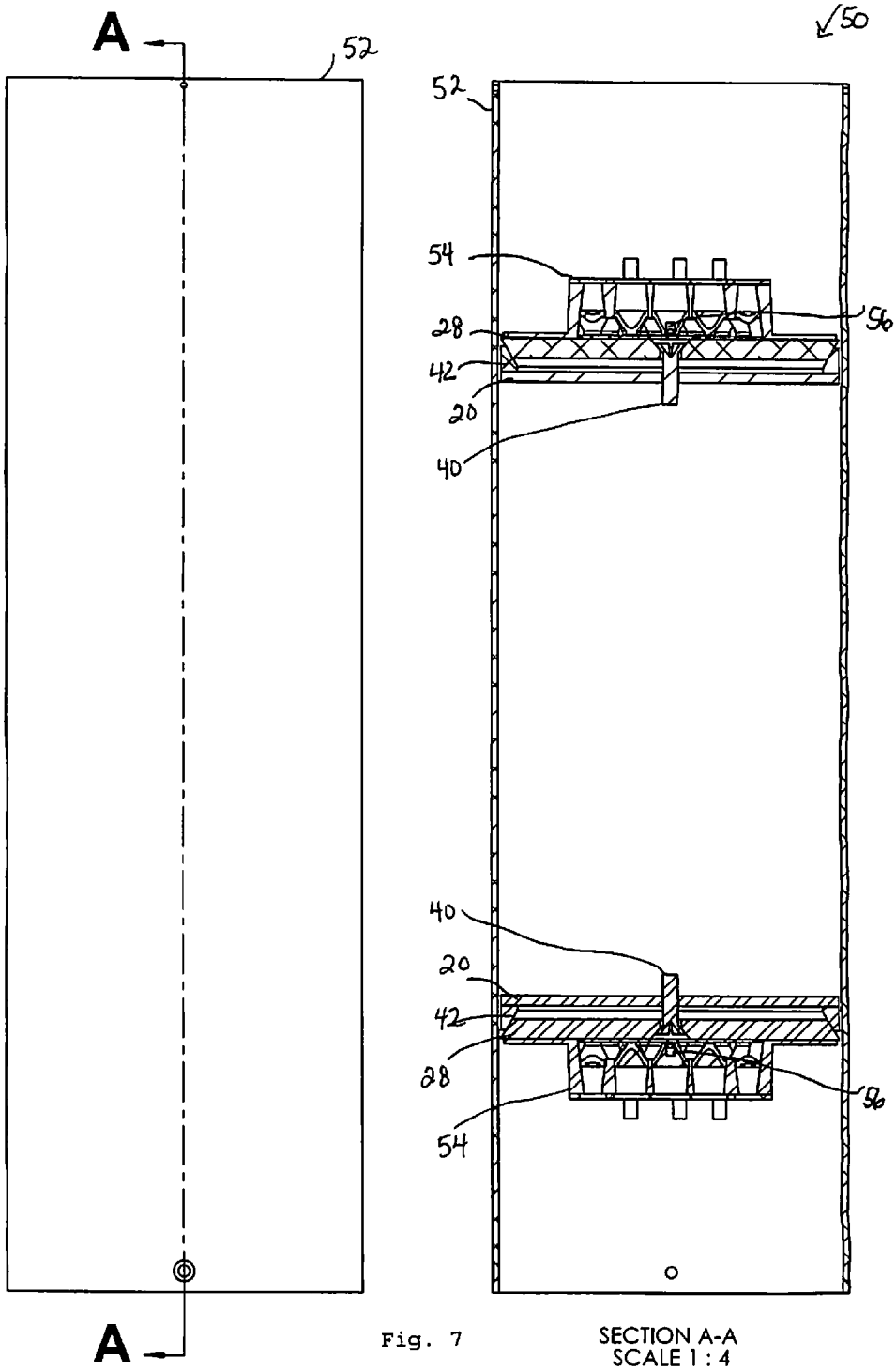
FIG. 7 is yet another cross-sectional view of the LED lighting apparatus shown in FIGS. 4A and 4B showing an LED lighting apparatus having two heat sink assemblies and two respective LED modules.

As shown in FIG. 6, heat sink assembly 10 has an LED module 54 mounted thereon. LED module 54 may be mounted to heat sink assembly 10 in any suitable manner. Often this is accomplished using a plurality of securement devices, such as bolts. Referring now to FIG. 7, more than one heat sink assembly 10 may be used in the LED lighting apparatus 50. Each LED module 54 is mounted on a respective heat sink assembly 10. More than one LED module 54 may be mounted on a single heat sink assembly 10 (not shown). In such case, LED module 54 mounted to outer face 32 of second plate 28 would require an LED module 54 that does not block access to aperture 36 so that sandwiching device 40 may be inserted therein for tightening heat sink assembly 10. Alternatively, a second LED module 54 may be mounted to outer face 32 of first plate 20. Also shown in FIGS. 6 and 7 is the electrical connections 56 for LED module 54.

Figure 5:
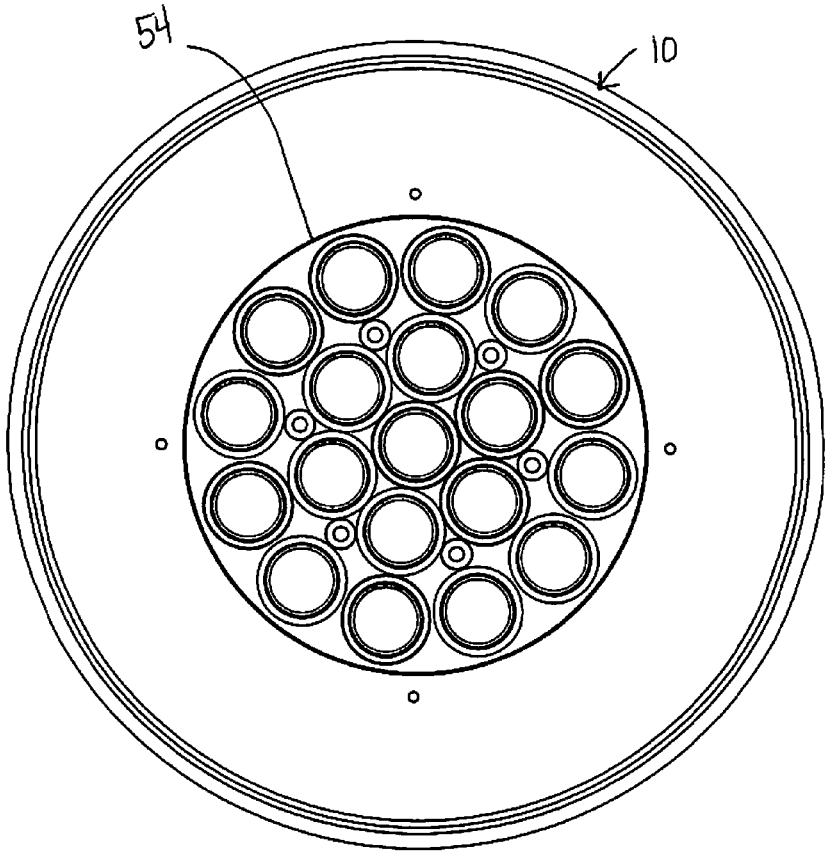
FIG. 5 is a top view of the LED lighting apparatus of FIG. 4.

Referring next to FIGS. 1 and 5, first and second plates, 20 and 28 respectively, have substantially equivalent footprints. The footprint is substantially equivalent to that of tubular housing 52 to facilitate heat-transfer contact between heat sink assembly 10 and the interior of tubular housing 52. As shown, first and second plates, 20 and 28 respectively, and expandable ring 42 are substantially circular. First and second plates, 20 and 28 and ring 42 may be concentrically mounted with respect to each other. Of course, it is to be understood that non-circular first and second plates and ring may be used if suitable for a particular lighting apparatus housing. It is preferable that first and second plates, 20 and 28, and ring 42 have substantially similar peripheries because this facilitates optimal transfer of heat generated by an LED module from heat sink assembly 10 to the inside of tubular housing 52.

When it is desirable to remove heat sink assembly 10 from tubular housing 52, for example because of required maintenance or repair, one may loosen sandwiching device 40, thereby permitting second plate 28 to move away from first plate 20 and facilitating retraction of expandable ring 42 from the sides of tubular housing 52. Then, heat sink assembly 10 may be easily removed from tubular housing 52 in any suitable manner. For example, one may pull heat sink assembly 10 up and out of tubular housing 52 by grabbing ahold of sandwiching device 40 and withdrawing assembly 10. Alternatively, heat sink assembly 10 could include, for example, finger holes, handle-like structure(s) or other suitable removal-facilitating device.

While the principles of this invention have been described in connection with specific embodiments, it should be understood clearly that these descriptions are made only by way of example and are not intended to limit the scope of the invention.

The invention claimed is:

1. An LED lighting apparatus comprising:

a tubular housing; and a heat sink assembly for mounting an LED module to the inside of the housing, the assembly comprising:

a first plate having inner and outer faces and a peripheral edge;

a second plate movable with respect to the first plate and having inner and outer faces and an inwardly-tapered peripheral camming surface;

an expandable ring sandwiched between the first and second plates and having an inward peripheral edge engaging the camming surface and an outward heat-transfer surface expandable to beyond the peripheries of the first and second plates; and a sandwiching-device adjustably interconnecting the first and second plates such that sandwiching of the ring facilitates heat-transfer engagement of the heat-transfer surface with the inside of the housing whereby, upon tightening of the sandwiching device, expandable ring is sandwiched by first and second plates thereby expanding the ring against the sides of the tubular housing to facilitate transfer of heat from the LED module to the heat sink module and therefrom to the tubular housing and for dissipation to the atmosphere.

2. The LED lighting apparatus of claim 1 wherein the tubular housing is of a heat-conductive material such that it forms a main heat sink member.

3. The LED lighting apparatus of claim 1 wherein the second plate defines an aperture through which the sandwiching device extends and the inner surface of the first plate includes a receptor port configured for drawing engagement with the sandwiching device.

4. The LED lighting apparatus of claim 3 wherein the receptor port is threaded and the sandwiching device is a screw the rotation of which draws the second plate toward the first plate.

5. The LED lighting apparatus of claim 1 wherein the expandable ring includes a gap, the gap facilitating radial expansion of the ring.

6. The LED lighting apparatus of claim 1 wherein the inward peripheral edge of the expandable ring and the inwardly-tapered peripheral camming surface are substantially parallel.

7. The LED lighting apparatus of claim 1 wherein the first and second plates have substantially equivalent footprints.

8. The LED lighting apparatus of claim 1 wherein the first and second plates and the ring are substantially circular.

9. The LED lighting apparatus of claim 1 wherein the first and second plates and the ring are concentrically mounted with respect to each other.

10. The LED lighting apparatus of claim 1 wherein the heat sink assembly is of heat-conductive material.

11. A heat sink assembly for mounting an LED module to a surrounding main heat sink member, the assembly comprising:

a first plate having inner and outer faces and a peripheral edge;

a second plate movable with respect to the first plate and having inner and outer faces and an inwardly-tapered peripheral camming surface;

an expandable ring sandwiched between the first and second plates and having an inward peripheral edge engaging the camming surface and an outward heat-transfer surface, expandable to beyond the peripheries of the first and second plates; and a sandwiching-device adjustably interconnecting the first and second plates such that sandwiching of the ring facilitates heat-transfer engagement of the heat-transfer surface with the main heat sink member.

12. The heat sink assembly of claim 1 wherein the second plate defines an aperture through which the sandwiching device extends and the inner surface of the first plate includes a receptor port configured for drawing engagement with the sandwiching device.

13. The heat sink assembly of claim 12 wherein the receptor port is threaded and the sandwiching device is a screw the rotation of which draws the second plate toward the first plate.

14. The heat sink assembly of claim 11 wherein the movable ring includes a gap, the gap facilitating radial expansion of the ring.

15. The heat sink assembly of claim 11 wherein the inward peripheral edge of the expandable ring and the inwardly-tapered peripheral camming surface substantially parallel.

16. The heat sink assembly of claim 1 wherein the first and second plates have substantially equivalent footprints.

17. The heat sink assembly of claim 11 wherein the first and second plates and the ring are substantially circular.

18. The heat sink assembly of claim 11 wherein the first and second plates and the ring are concentrically mounted with respect to each other.

19. The assembly of claim 11 wherein the heat sink assembly is of heat-conductive material.

20. A combined heat sink assembly and LED module for mounting to a surrounding main heat sink member, the assembly comprising:

a first plate having inner and outer faces and a peripheral edge;

a second plate movable with respect to the first plate and having inner and outer faces and an inwardly-tapered peripheral camming surface;

at least one LED module mounted on the outer face of the second plate;

an expandable ring sandwiched between the first and second plates and having an inward peripheral edge engaging the camming surface and an outward heat-transfer surface, expandable to beyond the peripheries of the first and second plates; and a sandwiching-device adjustably interconnecting the first and second plates such that sandwiching of the ring facilitates heat-transfer engagement of the heat-transfer surface with the main heat sink member.

21. The combined heat sink assembly and LED module of claim 20 wherein the first and second plates and the ring are substantially circular.

22. The combined heat sink assembly and LED module of claim 20 wherein the first and second plates and the ring are concentrically mounted with respect to each other.

23. The combined heat sink assembly and LED module of claim 20 wherein the second plate defines an aperture through which the sandwiching device extends and the inner surface of the first plate includes a receptor port configured for drawing engagement with the sandwiching device.

24. The combined heat sink assembly and LED module of claim 23 wherein the receptor port is threaded and the sandwiching device is a screw the rotation of which draws the second plate toward the first plate.

25. The heat sink assembly of claim 20 wherein the movable ring includes a gap, the gap facilitating radial expansion of the ring.

26. The assembly of claim 20 wherein the heat sink assembly is of heat-conductive material.

27. A method for mounting a removable heat-transfer facilitating assembly in a lighting apparatus having a tubular housing comprising the steps of:

providing a heat sink assembly for mounting an LED module to the inside of the housing, the assembly comprising:

a first plate having inner and outer faces and a peripheral edge;

a second plate movable with respect to the first plate and having inner and outer faces and an inwardly-tapered peripheral camming surface; and an expandable ring sandwiched between the first and second plates and having an inward peripheral edge engaging the camming surface and an outward heat-transfer surface;

a sandwiching device adjustably interconnecting the first and second plates such that sandwiching of the ring facilitates heat-transfer engagement of the heat-transfer surface with the inside of the tubular housing;

drawing the first and second plates together by tightening the sandwiching device and thereby expanding the ring against the sides of the housing, whereby easy access to the interior of the housing is facilitated for maintenance and repair.

28. The method of claim 27 wherein a heat generating device is an LED module.

* * * * *

UNITED STATES PATENT AND TRADEMARK OFFICE

CERTIFICATE OF CORRECTION

PATENT NO. : 7,473,011 B2
APPLICATION NO. : 11/744630
DATED : January 6, 2009
INVENTOR(S) : Kurt S. Wilcox et al.

It is certified that error appears in the above-identified patent and that said Letters Patent is hereby corrected as shown below:

In column 6, claim 12, line 60, delete "1" and insert --11--.

In column 7, claim 16, line 7, delete "1" and insert --11--.

Signed and Sealed this

Twenty-eighth Day of July, 2009

John Doll

JOHN DOLL
*Acting Director of the United States Patent and Trademark Office*